United States Patent [19]

Good

[11] Patent Number: 4,598,439

[45] Date of Patent: Jul. 8, 1986

[54] MAGNETIC-VACUUM-CLEANER ATTACHMENT FOR PICKING UP METAL OBJECTS

[76] Inventor: Jonathan R. Good, 260 E. Palmer, Costa Mesa, Calif. 92627

[21] Appl. No.: 678,080

[22] Filed: Dec. 4, 1984

[51] Int. Cl.[4] ..... A47L 9/00

[52] U.S. Cl. ..... 15/339; 209/215

[58] Field of Search ..... 15/339; 209/215

[56] References Cited

U.S. PATENT DOCUMENTS

| | | | |
|---|---|---|---|
| 2,288,115 | 6/1942 | Soldanels | 15/415 X |
| 2,677,461 | 5/1954 | Bodey | 15/339 X |
| 2,862,224 | 12/1958 | Swanson et al. | 15/339 X |
| 4,006,512 | 2/1977 | Saulson | 15/339 |

FOREIGN PATENT DOCUMENTS

| | | | |
|---|---|---|---|
| 1285273 | 1/1962 | France | 15/339 |
| 860882 | 2/1961 | United Kingdom | 15/339 |

*Primary Examiner*—Chris K. Moore

*Attorney, Agent, or Firm*—Francis X. LoJacono

[57] ABSTRACT

The present invention is directed to a magnetic pick-up attachment for conventional vacuum cleaners, the attachment being designed to be mounted under the housing of the cleaner and rearwardly of the vacuum intake to prevent the vacuum cleaner from being restricted in its movement. The attachment includes a magnet interposed between two oppositely disposed, protective, cover members which are secured to a bracket having an arm member and an end clamp. The attachment is secured to the side wall of the vacuum-cleaner housing by the end clamp, so as to project inwardly thereof. The arm further includes a longitudinal slot which allows lateral adjustment and placement of the magnet along the arm.

8 Claims, 4 Drawing Figures

MAGNETIC-VACUUM-CLEANER ATTACHMENT FOR PICKING UP METAL OBJECTS

BACKGROUND OF THE INVENTION

1. Field of the Invention

This invention relates to a magnetic pick-up device, and more particularly to a magnetic pick-up attachment for vacuum cleaners.

2. Description of the Prior Art

It is well known in the art that various problems and difficulties are encountered in providing suitable means for use in combination with vacuum cleaners in order to pick up the various metal objects, such as pins, staples, paper clips, hairpins, etc., which drop and collect on the floor. There is a particular problem in office buildings where staples become embedded within the nap of carpeting covering the surface of the floor. These staples are very difficult to dislodge sufficiently so as to be sucked into the conventional vacuum cleaner, and they are very often left behind in the carpeting.

Many types of magnetic pick-up devices have been tried and are presently in use. However, these devices have features that restrict their use, and they cause other problems with respect to their associated vacuum cleaners.

Most magnetic devices in use are designed to be attached along the front portion of a vacuum cleaner, just in front of the intake head of the vacuum, for the purpose of collecting the objects before the intake head passes over the object. However, in most cases the vacuum does not pick up an object, but it merely rolls the object. If the object is picked up, it is due to the rotation of the front beater bar of the vacuum cleaner, and not the vacuum itself. Thus, the object is generally dropped back on the floor and not removed.

Examples of known devices that are adapted to pick up metal objects are to be found in the following U.S. patents:

There is disclosed in U.S. Pat. No. 2,862,224 a floor-surfacing machine that is provided with an elongated magnetic element mounted between two end brackets which are secured to the front of the machine housing.

In U.S. Pat. No. 4,279,745 there is disclosed a magnetic attachment for vacuum cleaners that is also mounted to the front of the cleaner housing, the attachment comprising a longitudinally flexible housing provided with a plurality of magnet-containing pockets laterally spaced apart by thin webs.

Another magnetic pick-up device is disclosed in U.S. Pat. No. 4,006,512 which comprises a bumper and magnetic pick-up device for vacuum sweepers which is formed from a magnetized elastomer having magnetic poles aligned along its opposite longitudinal edges and supported on a metal strip. The metal strip is bent at each end to define brackets which mount on the front end of the sweeper.

Still another magnetic pick-up of this type is disclosed in U.S. Pat. No. 4,300,260. This device comprises an elongated strip of magnetized flexible material which is adapted to overlie, connect to, and depend from the front face of a vacuum-cleaner housing.

SUMMARY AND OBJECTS OF THE INVENTION

The present invention has for an important object a provision wherein a magnetic attachment is so designed as to be mounted under the vacuum-cleaner housing, and more particularly to be positioned rearwardly of the vacuum-intake nozzle.

It is another object of the invention to provide a magnetic attachment for vacuum cleaners wherein the attachment is readily attached to the cleaner housing, so as not to interfere with the operation of the cleaner or prevent normal operation even in difficult areas, such as against walls and furniture.

Still another object of the invention is to provide a magnetic device of this character that includes an enlarged single magnet having an upper and lower cover plate, and a laterally extended clamp-type bracket that is readily secured to the lower edge of the cleaner housing by a screw.

A further object of the invention is to provide a magnetic attachment of this character wherein the magnet can be laterally adjusted to various positions relative to the particular vacuum-cleaner design, whereby the magnet can be centrally positioned under the housing or to one side thereof, as required.

A still further object of the present invention is to provide a magnetic attachment of this character that is easy to install on most known vacuum cleaners, and that needs no special tools for mounting.

Still another object of the invention is to provide a device of this character that is relatively inexpensive to manufacture, and is both simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
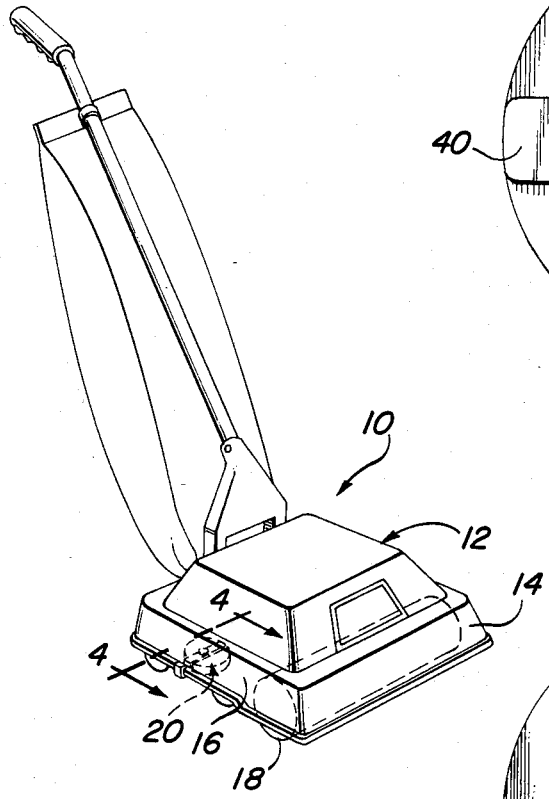
FIG. 1 is a pictorial view of a typical upright vacuum cleaner, showing the present invention mounted in the preferred position under the housing and rearwardly of the vacuum-intake nozzle and beater-brush bar.
Figure 2:
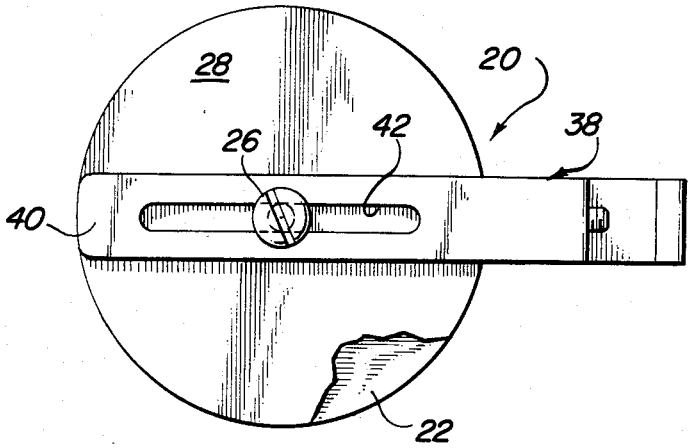
FIG. 2 is a top-plan view of the magnetic attachment.

Referring more particularly to FIG. 1, there is shown a pictorial view of a conventional vacuum cleaner, generally indicated at 10. Vacuum cleaner 10 includes a housing 12 having a front face wall 14, side walls 16, and a beater brush or bar 18 which is adjacent to the vacuum intake. The conventional vacuum cleaners are usually designed to allow the vacuum intake and beater bar to operate in close proximity to walls and other objects, and for this reason the cleaners do not have any outwardly projecting portions to restrict them.

Accordingly, the present invention is designed to be readily mounted to the conventional vacuum cleaner housing 12, without adding any restrictions thereto.

This is accomplished by allowing the device to be located under the housing and rearwardly of the ihtake nozzle of the cleaner, as seen in FIG. 1.

The magnetic attachment, designated generally at 20, comprises a magnet 22 which is illustrated in the preferred round configuration. However, it can be in any suitable form having a central bore 24 disposed therein. Bore 24 is adapted to receive a screw or bolt 26 therethrough.

Figure 3:
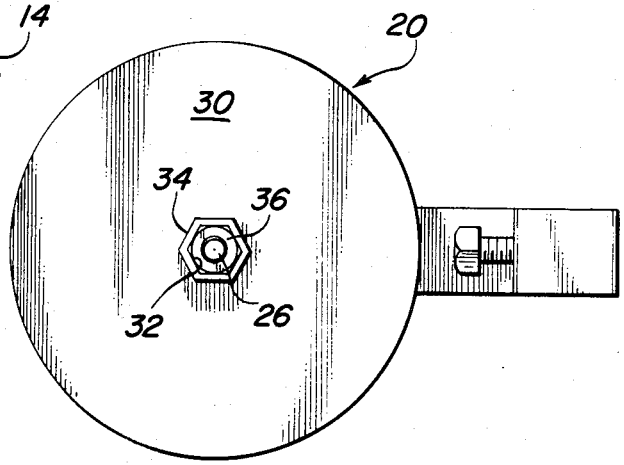
FIG. 3 is a bottom-plan view thereof.
Figure 4:
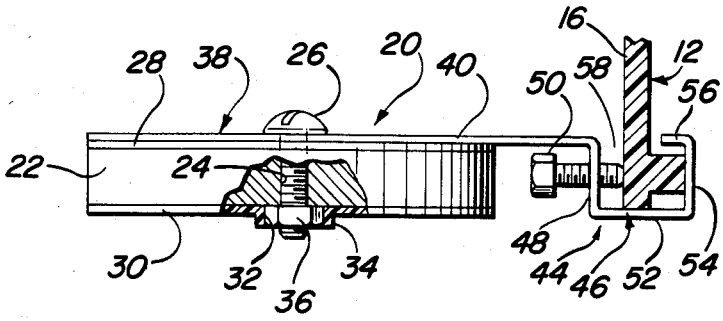
FIG. 4 is a side-elevational view, showing the attachment arm secured to a portion of the vacuum-cleaner housing and with the central portion of the magnet broken away.

Preferably, magnet 22 is sandwiched or interposed between two plates or cover members 28 and 30, respectively, the cover members being of any suitable material, but preferably a plastic or non-magnetic material. The top cover member 28 is also provided with a hole aligned with bore 24, so as to receive bolt 26 therethrough. The lower or bottom cover member 30 is formed having an opening defined by a recess 32 defined by a depending flange 34, the recess being formed to receive nut 36 therein, as seen in FIGS. 3 and 4.

The sandwich arrangement is adjustably secured to a bracket means, designated at 38 which comprises an elongated arm member 40 having a longitudinal slot 42 formed therein, so as to receive the bolt 26 therethrough. Thus, magnet 22 and its cover plates can be positioned along arm member 40 and locked into position by bolt 26, the nut 36 being captured in recess 32.

Arm member 40 includes a clamp means 44 which comprises a somewhat C-shaped clamp member 46 defined by a first bent member 48 that is adapted to threadably receive a machine screw 50, or the like. A second member 52 is again bent outwardly and then upwardly, thus defining a third member 54 parallel to the first member. The third member is provided with an in-turned flange 56. This configuration leaves a space 58 which allows clamp member 46 to receive the lower peripheral edge of wall 16 of the housing 12. Once the clamp is positioned over wall 16, machine screw 50 is tightened, thus locking the magnetic device to the housing so that only member 54 and flange 56 are outwardly visible. Hence, the vacuum cleaner has a normal appearance and is allowed to function in the usual manner.

It is, therefore, very important to note the location of magnet 22. That is, it is positioned rearwardly of the intake nozzle so as to pick up any metal objects that the cleaner has passed over, or has dropped from the vacuum intake.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A magnetic pick-up attachment for vacuum cleaners, wherein the attachment is adapted to be mounted under the housing of the vacuum cleaner and rearwardly of the vacuum intake, said atachment comprising:

a magnet having a central bore disposed therein;

a first protective plate positioned above the magnet, and having a central hole therein to be aligned with said bore of said magnet;

a second protective plate positioned below said magnet, and including an aligned opening therein; and a securing bracket attached to said magnet, and adapted to be clamped to said housing; and means to secure said bracket to said magnet and its associated cover members.

2. A magnetic pick-up attachment as recited in claim 1, wherein said securing bracket is formed having an elongated arm member and a clamping means integrally formed on one end of said arm member.

3. A magnetic pick-up attachment as recited in claim 2, including means to laterally position said magnet along said arm member.

4. A magnetic pick-up attachment as recited in claim 3, wherein said securing means comprises a nut and bolt, said bolt passing through said magnet, said covers, and said arm member of said bracket.

5. A magnetic pick-up attachment as recited in claim 4, wherein said lateral positioning means comprises a longitudinal slot formed in said arm member of said bracket.

6. A magnetic pick-up attachment as recited in claim 5, wherein said clamping means comprises a substantially C-shaped clamp member having a set screw threadably mounted thereto.

7. A magnetic pick-up attachment for vacuum cleaners, wherein said attachment is adapted to be mounted under the housing of the vacuum cleaner and rearwardly of its vacuum intake, said attachment comprising:

a magnet having a central bore disposed therein;

a mounting bracket having an elongated arm member and a clamp means formed at one end thereof; and means for securing said mounting bracket to said magnet.

8. A magnetic pick-up attachment as recited in claim 7, wherein said arm member includes an elongated slot formed therein to allow said magnet to be adjusted laterally along said slot relative to said housing.

* * * * *